United States Patent [19]

Kay et al.

[11] Patent Number: 5,033,652

[45] Date of Patent: Jul. 23, 1991

[54] FLUID DISPENSER WITH INADVERTENT ACTUATION LOCK

[75] Inventors: Nate Kay, Encino; Donald W. McNab, Long Beach, both of Calif.

[73] Assignee: Photofinish Cosmetics, Inc., Encino, Calif.

[21] Appl. No.: 486,528

[22] Filed: Feb. 28, 1990

[51] Int. Cl.[5] ..... B67B 5/00

[52] U.S. Cl. ..... 222/153; 222/213; 222/518; 401/61; 401/269

[58] Field of Search ..... 222/153, 182, 213, 509, 222/518, 384, 387, 391; 401/61, 269

[56] References Cited

U.S. PATENT DOCUMENTS

| | | | |
|---|---|---|---|
| 3,902,815 | 9/1975 | Williams | 222/518 |
| 4,859,104 | 8/1989 | Roeder | 401/269 |
| 4,874,117 | 10/1989 | Kay et al. | 222/487 |
| 4,892,427 | 1/1990 | Ford | 222/391 |

*Primary Examiner*—Donald T. Hajec
*Assistant Examiner*—Shari Wunsch
*Attorney, Agent, or Firm*—Cohen, Pontani & Lieberman

[57] ABSTRACT

A hand-held, manually-actuated dispenser for selective discharge of a stored fluid includes a discharge outlet and a reciprocatable actuating member movable between a first position normally closing the outlet and a second position opening the outlet to enable a discharge of stored fluid. The actuating member carries an inadvertent-actuation locking element which is automatically engageable with an inwardly-displaceable portion of the dispenser housing. When an associated closure cap is seated about the discharge end of the dispenser during periods of nonuse of the device, the housing portion is inwardly-displaced by the cap into cooperative engagement with the locking element whereby movement of the actuating member out of its first, outlet-closing position and, accordingly, any release of stored fluid from within the dispenser interior are prevented.

16 Claims, 2 Drawing Sheets

FLUID DISPENSER WITH INADVERTENT ACTUATION LOCK

FIELD OF THE INVENTION

The present invention relates to fluid dispensers and, more particularly, to hydraulically-driven, pump-like dispensers operable for manually-actuated, operator-controlled discharge of a stored fluid.

BACKGROUND OF THE INVENTION

Hand-held dispensers, manually-actuatable by a user for operator-controlled discharge of a stored fluid, are widely known in numerous structural configurations and for use with a wide variety of fluids, particularly liquids. In some such dispensers, the operating mechanism is in the nature of a mechanically-driven pump wherein a discharge of stored or contained fluid is effected, by way of example, through hydraulic action, as by temporarily reducing the interior volume of the dispenser to increase the pressure within the dispenser housing and thereby forcibly discharge stored fluid therefrom. Thus, in response to user-selected inward depression or deformation of a part of or element on the dispenser housing, a controllable or predetermined quantity of stored fluid may be ejected through a discharge opening of the dispenser for application to a workpiece. One example of such a dispenser is disclosed in U.S. Pat. No. 4,874,117 of Oct. 17, 1989 to Kay et al.

One problem in dispensers of this type is that, during periods of nonuse of the dispenser, it is all to easy, and not uncommon, for a user or mere handler of the device to inadvertently depress the actuating part of the dispenser and thereby effect an unintended discharge of fluid therefrom. This may result in staining or other damage to clothing and the like or, at the very least, to an unsightly and inconvenient mess and unavoidable embarassment. Even where an associated closure cap is disposed about the discharge end or outlet of the dispenser, one or repeated discharges of fluid into the cap interior are likely to interfere with subsequent operation of the dispenser and to effect sufficient damage to the cap and/or the dispenser outlet region as to seriously reduce the further utility of the dispenser.

The prior art proposes various mechanisms or arrangements seeking to avoid such inadvertent actuation of a fluid dispenser during periods of nonuse. In the aforementioned Kay patent, for example, user-effected inwardly-directed displacement of the actuating button, by which a discharge of fluid is initiated, is prevented, when an associated closure cap is disposed on the dispenser housing, by way of a housing tab or finger that is driven under the button when the cap is seated on the dispenser. Locking mechanisms of this type, however, are subject to eventual failure through material fatigue or failure or distortion should inward force or pressure be repeatedly applied to the actuating button during periods when the button is locked. Once the button is inwardly displaceable, by even a small amount, other internally-disposed actuating members through which the discharge opening is unsealed and a discharge of fluid is driven may be operated whereby an unintended and undesired discharge of stored fluid takes place. Moreover, even in the absence of inward movement of the positionally-locked, user-driven actuating button or the like, those internal dispenser parts through which the discharge outlet is operatively unsealed remain movable or displaceable and are therefore capable of permitting an unintended release of stored fluid from the dispenser interior.

OBJECTS OF THE INVENTION

It is accordingly a desideratum of the present invention to provide an inadvertent-actuation locking arrangement in a fluid dispenser that overcomes the deficiencies and drawbacks of the prior art.

It is a particular object of the invention to provide such an arrangement wherein those operating components of the dispenser through the operation of which a discharge outlet is opened to permit a release of stored fluid are locked against movement when an associated closure cap is seated on the dispenser.

It is a further object of the invention to provide such an arrangement wherein locking of the operating components of the dispenser is effected automatically by seating of the closure cap over or about the dispenser outlet.

Still another object of the invention is to provide such a dispenser that may be constructed of readily available materials, using commercially practical methods, and at economically-favorable costs.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein similar reference characters denote similar elements throughout the several views.

DETAILED DESCRIPTION OF THE PREFERRED EMBODIMENTS

The present invention is directed to dispensers for generally manually-effected, operator-controlled discharge of a stored, or otherwise contained, flowable fluid, typically a liquid. A particular feature and focus of the invention is the provision of a containment barrier as at least a portion of the housing of such a dispenser to enable the containment of volatile fluids and, even more particularly, of such a barrier that includes a flexibly deformable portion. Volatile fluids to which the containment barrier of the invention is specifically directed and against which it is advantageously effective include, by way of example, ethylacetate, butylacetate, isoparafin and tolulene, thus enabling a fluid dispenser constructed in accordance with the invention to be used for the storage and selective discharge of such highly volatile products as nail polish. Additional uses of these teachings in connection with the storage and dispensing of other cosmetic, pharmaceutical, paint, adhesive and correction fluid related products, for example, are also within the intended scope and contemplation of the invention.

Another important feature of the invention is the provision of an arrangement by which the discharge of fluid from within the dispenser is prevented while a closure cap is disposed on or about an outlet or discharge portion of the dispenser. In accordance with the present invention, this feature is implemented by locking, through actions automatically initiated by placement of an associated closure cap over the fluid discharge outlet, an actuator member, normally arranged for operative displacement to effect a discharge of fluid, against movement from a position closing the fluid discharge opening of the dispenser. This discharge locking feature may be implemented in a fluid dispenser incorporating the containment barrier of the invention so as to enable use of the dispenser with volatile fluids or, in the alternative, in a dispenser structure lacking or omitting or otherwise not including such a barrier.

Figure 1:
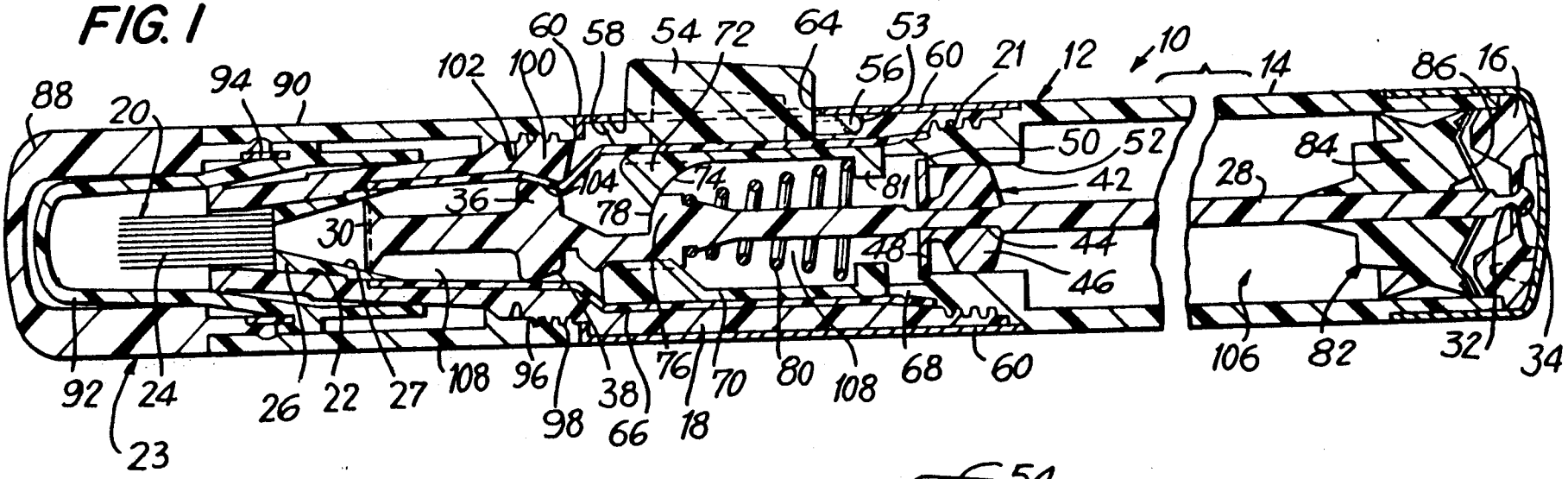
FIG. 1 is a side view, in cross-section, of a fluid dispenser and associated closure cap constructed in accordance with the teachings of the present invention.
Figures 2, 4:
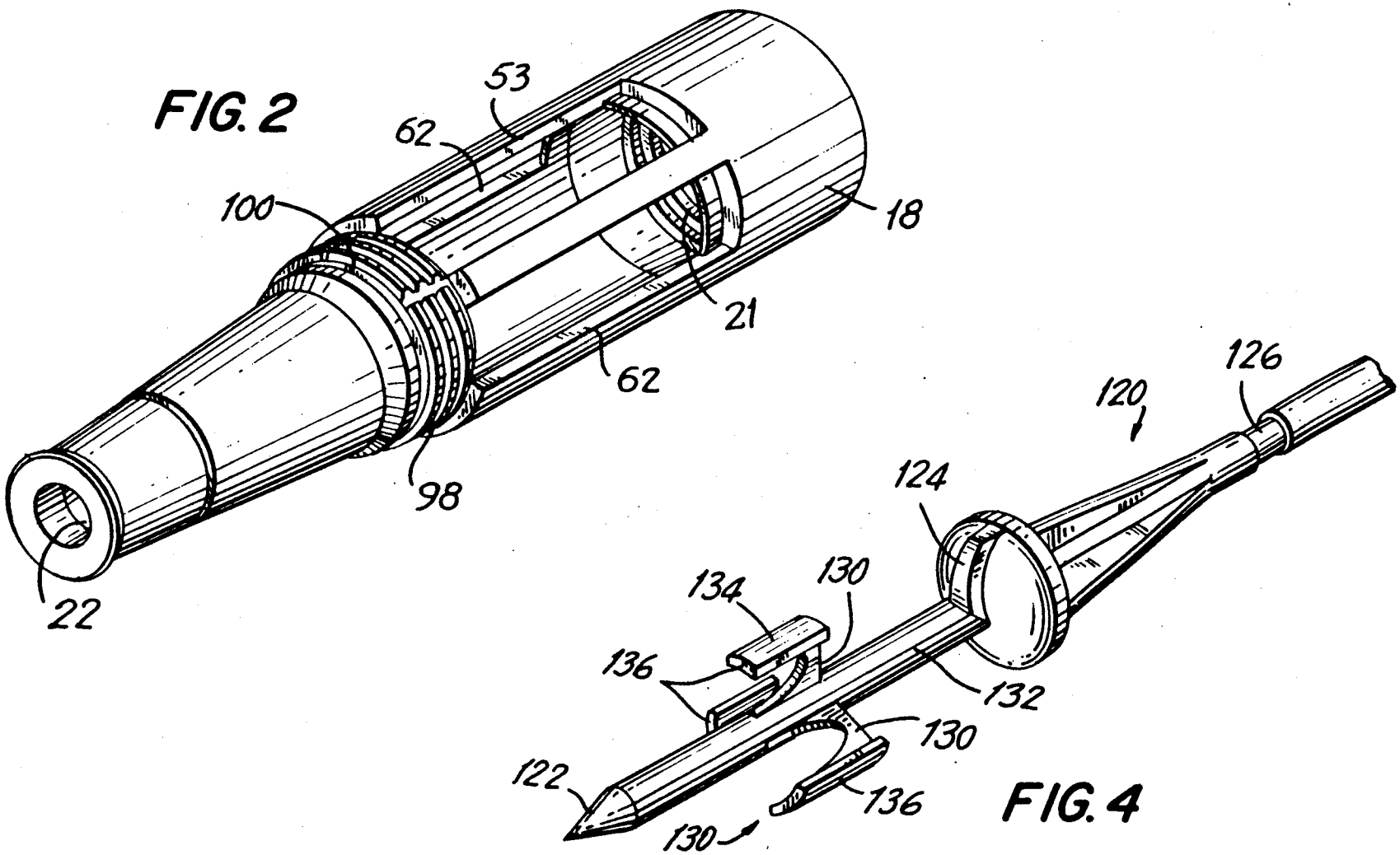
FIG. 2 is an elevated perspective view of the nosetip that forms a portion of the housing of the fluid dispenser of FIG. 1.
FIG. 4 is an elevated perspective view of an alternate embodiment of a reciprocatable actuation rod for use in a fluid dispenser such as that illustrated in FIG. 1 and incorporating a modified inadvertent-actuation locking member.

Turning now to the drawings, a fluid dispenser 10 constructed in accordance with the invention is depicted in the cross-sectional side view of FIG. 1. The dispenser includes an elongated housing 12 that, in the illustrated embodiment, comprises a multi-part structure formed of a fluid storage body or barrel 14, a rear closure member 16 substantially closing the rearward end of the barrel 14, and a nosetip 18 for carrying a bristle brush 20 through which stored fluid is dischargeable from the housing 12 for selective application to a workpiece. Each of the barrel 14 and nosetip 18 are of generally tubular form and carry complementary threads 21 for suitably joining these housing parts to each other. The nosetip 18 is, moreover, generally radially-inwardly tapered proximate its forward or brush-carrying or discharge end at which a fluid discharge opening or outlet 22 is defined; an elevated perspective view of the nosetip 18 is depicted in FIG. 2. In FIG. 1, a closure cap 23 is also shown removably disposed over the discharge end of the housing nosetip 18 for protectively encasing the brush bristles 24 during periods of nonuse of the dispenser 10.

The brush 20 may be of any appropriate configuration and material(s) of construction as, for the most part, a matter of design choice. For example, the brush may be of the type disclosed in U.S. patent application Ser. No. 222,808 filed July 22, 1988. In the configuration shown in the drawings herein, the brush is formed of a plurality of relatively freely movable bristles 24 and an attached head section 26 retained in the end of the nosetip 18 at the fluid discharge opening 22. The brush head 26 is provided with an inwardly tapered fluid passageway 27 through which fluid discharged from the dispenser housing is directed onto the bristles 24 for application to a workpiece. Of course, depending upon the intended use of the dispenser 10, and/or the particular fluid to be stored or contained therein and discharged therefrom, the brush 20 may be replaced, at the option of the manufacturer or designer, by an alternate or other applicator or the like by which the fluid is appliable to a workpiece. Indeed, the dispenser may be constructed so as to simply discharge stored fluid directly onto a workpiece or target surface through the discharge opening 22, which may be suitably sized and shaped for that purpose, without the intervention of a nosetip-carried applicator such, for example, as the illustrated brush 20.

An elongated rod or member 28 is disposed within the interior of the dispenser ho using 12 for longitudinally-oriented reciprocating movement between a first position illustrated in FIG. 1 and a second position relatively rightward of the FIG. 1 position. Rod 28 carries at its forward end a valve stopper 30 sized for closing, preferably fluid-tightly sealing, the fluid discharge opening 22 and, more particularly, the brush head passageway 27 that functions as the discharge opening in the dispenser embodiment of FIG. 1. The rear or opposite end of the rod 28 has a diametrically reduced portion that is loosely journalled through an opening or bore 32 in the rear closure member 16 and which terminates in a knob 34. Knob 34 closes or seals the bore 32 in the first (i.e. illustrated) position of the rod 28 and, when the actuating rod is operatively moved to the right to or toward its second position, the knob is carried away from the bore 32 to substantially open the bore and permit the entry of ambient air into the rearmost portion of the barrel 14.

The rod 28 also carries, rearwardly spaced from the valve stopper 30, a radially-outwardly extending lock member which, in the FIG. 1 embodiment of the fluid dispenser, is in the form of a boss 36 having a rearwardly-inwardly tapered or ramped engagement surface 38. The surface 38 is engageable, as will hereinafter become apparent, with a radially-inwardly movable portion of the nosetip 18 when the closure cap 23 is disposed about the discharge end of the dispenser so as to prevent rearward movement of the actuating rod 28 from its first to its second position. The boss 36 may be solid or, alternatively, may be partly hollowed out, as for example on the rearward-facing side thereof, to provide for flexible deformability of the lock member and thereby enable an enhanced frictional or interference engagement between the surface 38 and the hereinafter described, inwardly-movable nosetip portion. The boss 36 may even more preferably, particularly where the contained fluid for discharge is relatively viscous such, for example, as nail polish, include suitable throughbores or passages or cutouts (not shown) radially inward of its peripheral surface 38, so as facilitate the free flow and passage of fluid forwardly beyond the boss; for this purpose the boss might take on the general configuration of a bicycle wheel or the like.

Additionally carried on the actuating rod 28, rearwardly of the boss 36 and radially-inwardly proximate the rearward end of the nosetip 18, is a one-way or check valve member 42 that is longitudinally slidable relative to the rod 28 over a limited linear range defined by a diametrically-reduced portion 44 of the rod. The member 42 is formed of a valve body 46 and a valve disk 48 which is sized for engagement, in the rearmost position of the member 42, with at least the edges of a forward-facing continuous wall surface or ledge 50 located proximate the forward end of the barrel 14 for the purpose of closing a passage 52 defined in the barrel forward end. The member 42 may, for example, be formed of an elastomeric material so that the disk 48 functions, in cooperation with the ledge 50, in the manner of a flapper valve. A spring (not shown) may optionally be provided forwardly of and against the disk 48 so as to normally urge the disk rearward and thereby facilitate its operation as a one-way or check valve in accordance with the invention; the operation of the valve member 42 will be further detailed as this description proceeds.

The nosetip 18 is further provided with a top-disposed (in FIGS. 1 and 2) cutout 53 through which a radially-inwardly movable actuating lever or button 54 partially projects. The button 54, which appears in FIG. 1 in its first or unactuated or most radially-outer position, is pivotally secured to the nosetip at a rearward extension 56 and additionally carries a front-mounted, generally outwardly extending finger 58. The finger 58 cooperatively engages, in the illustrated first or unactuated position of the button, the underside of an outer shell or sleeve 60 that circumferentially overlies the nosetip periphery and longitudinally extends forwardly from the threaded engagement of the nosetip 18 and barrel 14 to proximate the forwardmost edge or boundary of the cutout 53. As seen in FIG. 2, the nosetip also includes a pair of oppositely-disposed side windows 62. It should be recognized and understood that the sleeve 60 overlies and covers the windows 62 but includes an opening or cutout 64 sized and shaped, and aligned with the button 54 and with at least a predetermined portion of the nosetip cutout 53, for accomodating the radially-outward projection of the button beyond the plane of the sleeve.

A stored fluid containment barrier 66 in the form of a substantially continuous sidewall which defines an elongated sleeve or tube is provided in the nosetip 18 in closely proximate or closely adjacent relation to the interior periphery of the nosetip. As seen in the embodiment of FIG. 1, the wall or sidewall or membrane that forms the barrier 66 closely conforms in shape and size to the interior periphery of the nosetip 18 and is disposed in substantial surface-to-surface contact or abutment with the nosetip wall. The barrier wall covers the entirety of the nosetip cutout 53 and, in the FIG. 1 embodiment of the fluid dispenser, longitudinally extends along much of the length of the nosetip, being secured at its rearward end between the nosetip wall and a lip 68 carried on the barrel forward end and, at its forward end, between the nosetip wall and the brush head 26. Nevertheless, it should be clearly understood that the details and extent of longitudinal and circumferential extension or coverage of the barrier 66, and the manner of its securement in place in the dispenser, may be significantly varied from that illustrated as a matter of design choice and in at least partial dependence on the structure and intended use of the dispenser and the fluid to be stored in and/or discharged therefrom. The only requirement, in accordance with the invention, is that the barrier fully cover the nosetip cutout 53 or, in other dispenser arrangements, its equivalent. It is most preferred that, whatever the extent of longitudinal and circumferential coverage by the containment barrier 66, the barrier wall generally and substantially conforms to the contour(s) of the interior peripheral wall of that portion of the housing in proximity to which it is located. Thus, in the dispenser embodiment illustrated by way of example in FIG. 1, wherein the the generally tubular containment barrier 66 lies in substantial surface-to-surface abutment with much of the nosetip interior periphery, the barrier sidewall has an outer peripheral contour that closely conforms or corresponds, in both size and shape, to the interior peripheral contour of the immediately adjacent and overlaid portions of the nosetip 18.

In order to enable the containment of highly volatile fluids such, by way of example, as those present when the stored fluid is nail polish, the containment barrier 66 is fabricated of polytetrafluoroethylene, also commonly known (and hereinafter referred to) as PTFE. The barrier wall, at least in the area proximate or radially-inwardly of the actuator button 54, has a predetermined thickness selected so as to render the wall 66 sufficiently flexible, and most preferably resiliently flexible, for deformably accomodating radially-inward movement of the actuating button 54 and the subsequent return of the button to its FIG. 1 position. A preferred barrier wall thickness for this purpose is in the range of approximately 0.0075 to 0.01 inches, and most preferably approximately 0.0075 inches, although even greater wall thicknesses are within the scope and contemplation of the invention so long as the desired wall flexibility and functionality is maintained.

A currently preferred method of fabricating the generally tubular barrier sidewall 66 will now be described. The starting material is an elongated, in this instance, relatively thin-walled tube of PTFE material. The tube initially has a substantially constant diameter and may be supplied as a continuous length of extruded PTFE in tubular form from which predetermined lengths are severed in accordance with the requirements of the dispenser structure in which the containment barrier is to be incorporated. In a preferred embodiment of the barrier fabrication method, the initial, substantially constant diameter of the tube substantially corresponds to the interior diameter of that portion of the dispenser housing at which deformable flexibility of the barrier wall is required in accordance with the invention. Most preferably, that diameter is also the largest housing interior diameter proximate which the containment barrier 66 is to be disposed in the completed dispenser. It is further preferred, for reasons that will soon be apparent, that the wall thickness of the initial, substantially constant diameter PTFE tube be in the range of approximately 0.0075 to 0.01 inches and, most preferably, approximately 0.0075 inches which, as heretofore noted, assures a suitable degree of deformable flexibility of the containment barrier wall.

The substantially constant diameter PTFE tube is placed over a mandrel, in the present instance, for example, a rod-like form, which has a radially-outer peripheral contour that substantially corresponds in size and shape to the intended final contour of the containment barrier. Where, as in the FIG. 1 dispenser 10, the barrier 66 is disposed in surface-to-surface abutment with the nosetip wall, the mandrel contour substantially complementarily conforms or corresponds to the radially-inner peripheral contour of that portion of the nosetip 18 to be overlaid by the containment barrier. Thus, in a most preferred arrangement, the internal diameter of the substantially constant diameter PTFE tube is initially substantially the same as the outer diameter of the largest diameter of the predeterminately contoured portion of the mandrel over which the PTFE tube is placed in this inventive method step.

The PTFE tube, supported on the forming mandrel, is next subjected to heat at a predetermined temperature in excess of the PTFE melting temperature for a period sufficient to cause the PTFE tube to diametrically shrink about and to the diametric mandrel contour. Inasmuch as the melting temperature of PTFE is approximately 620° F., a suitably higher temperature such, for example, as approximately 675° F., may be employed. As the PTFE tube wall shrinks down to the relatively smaller diameter portions of the mandrel, the thickness of the wall portions in these diametrically reduced or shrunken areas proportionally increases as the tube wall accomodates the additional PTFE material from the initially larger diameter tube in the now-reduced or shrunken diameter portions. In these now relatively thicker wall portions or regions the flexibility of the wall is correspondingly decreased or, in relatively extreme cases, could be effectively eliminated. On the other hand, those regions in which little or no shrinkage of the initial, substantially constant diameter of the PTFE wall has occurred retain the appreciable, or at least predetermined intended, flexibility required for deformably accomodating radially-inward movement of the actuating button 18 or of other inwardly-displaceable structural components or features in accordance with alternate forms of a fluid dispenser or the like. Thus, the heat-induced diametric shrinking of the PTFE tube about the forming mandrel results in relatively stiffer or less flexible barrier wall portions in reduced-diameter regions without sacrificing the intended and required, in accordance with the invention, flexibility of the larger-diameter portions of the completed containment barrier tube. At the same time, this diametric-reduction heating step of the inventive barrier fabrication method maintains the molecular structure of the PTFE material that enables it to present an unusually effective containment and corrosion resistant barrier for highly volatile fluids such, for example, as nail polish and the like.

The diametrically-reduced or shrunken PTFE tube, after cooling or being cooled to at least below the melting temperature of the material, is next removed from about the forming mandrel and is then disposed within or in appropriate association with the dispenser housing. This disposition of the formed tube within or in otherwise predetermined relation to a housing or housing part may be carried out in any of a variety of ways within the contemplation of the invention and, substantially, as a matter of design choice. For example, in the FIG. 1 dispenser 10 the nosetip 18 may be fully or substantially fully preformed in any suitable manner, as for example by conventionally molding the same of polypropylene, prior to its receipt of the formed PTFE barrier tube 66 which is then longitudinally inserted into its intended, surface-to-surface abutting placement within the interior of the nosetip. Alternatively, the nosetip (or other housing portion within which the containment barrier is to be accomodated) may be formed directly on and about the diametrically-reduced or completed PTFE tube so as to form a single, unitary structure with the barrier sidewall, in effect, laminated in surface-to-surface engagement with the radially-interior peripheral wall of the nosetip. This alternative method step may be carried out by, for example, insert molding of the nosetip body over and about the preformed PTFE tube in a transfer-type press, or in any other suitable manner as a matter of design choice. Other methods of placing or securing the containment barrier in operative association with a housing part, although not expressly described herein, are also within the contemplation of the invention.

Whatever the selectively employed method of disposing the PTFE barrier tube within the interior of the nosetip or other housing part(s), the result is a completed housing or housing portion which incorporates a volatile fluid containment barrier that is suitably flexible, at least in a predetermined region thereof, for accomodating deformable movement of the barrier during operative use of the dispenser.

Returning now to a description of the fluid dispenser 10 illustrated by way of example in FIG. 1 of the drawings, a lever guide 70 is disposed in the nosetip 18 so as to sandwich the barrier sidewall 66 in interposed abutment between the outer periphery of the guide 70 and the actuating button 54; at other circumferential areas the barrier is interposed between the lever guide periphery and the radially-interior periphery of the nosetip. The lever guide 70 carries, radially-inward of the button 54, a lever arm or portion 72 arranged for resiliently flexed, radially-inward movability and including a concavely-curved guide surface 74. Thus, as the actuating button 54 is inwardly depressed or displaced, it inwardly and flexibly deforms the containment barrier wall 66 and, correspondingly, inwardly flexes and displaces the forward or free end of the lever arm 72 of the guide 70.

Immediately inwardly-adjacent the curved guide surface 74 of the lever guide 70, the actuating rod 28 is provided with a diametrically-enlarged land or boss 76 on which a convexly-curved camming surface 78 is defined. The surface 78, which is located for relatively slidable face-to-face engagement with the lever guide surface 74, has a convex curvature that closely matches and complements the concave curvature of the surface 78. A compression spring 80 extends between the rear face of the boss 76 and a spring perch 81 provided on the rearward end of the lever guide 70 for normally urging the longitudinally movable actuating rod to the left (in FIG. 1) to close the fluid discharge opening 22 through engagement of the rod-carried stopper 30 with the tapered passageway 27 of the brush head 26. As should by now be apparent, radially-inward displacement of the actuating button 54 inwardly deforms the immediately-underlying wall portion of the containment barrier 66, correspondingly inwardly flexes the lever arm 72 of the guide 70 and, through relative sliding movement of the abutting complementary curved camming surfaces 74, 78, drives the actuating rod 28 through a rightward (in FIG. 1) or rearward displacement whereby the fluid discharge opening 22 is opened to permit a discharge of stored fluid and, concurrently, the bore 32 in the rear closure member 16 is unsealed to enable the entry of ambient air into the rear end of the barrel 14. Thus, the slidably engaged curved surfaces 74, 78 are operatively effective to convert the radially-inwardly directed displacement of the button 54 to the longitudinally or axially oriented displacement of the rod 28.

Also incorporated within the dispenser housing 12 and, more particularly, within the fluid storage barrel 14, is a piston 82 that is operatively movable, on and along the substantially constant diameter rearward portion of the actuating rod 28, in only a single direction, to the left in FIG. 1, as the volume of stored fluid remaining in the barrel 14 decreases with use of the dispenser 10. Thus, it is intended that substantially all of the fluid stored or contained within the barrel remain to the left or forwardly of the piston and, as fluid is discharged from the dispenser and the piston moves to the left, the correspondingly increasing barrel volume to the right or rearward of the piston fills with ambient air that enters the barrel through the rear closure member bore 32.

As shown in FIG. 1, and by way of example, the piston 82 is formed of a suitably configured piston body 84 and, secured to the rearward face of the body 84, a spring member 86. The circumferentially-outer periphery of the spring member 86 angularly engages the barrel wall so as to permit leftward, but not rightward, movement of the spring member 86 and attached piston body 84 along and relative to the sidewall of barrel 14. Similarly, the radially interior periphery of the spring member 86 angularly engages the actuating rod 28 so as to permit leftward, but not rightward, movement of the spring member and attached piston body 84 along and relative to the actuating rod 28. Thus, in response to rearward or rightward (in FIG. 1) movement of the actuating rod, the piston 82 remains positionally fixed relative to the barrel 14 as the rod 28 slides rearwardly through the relatively fixed piston body 84. With a subsequent forward or leftward return movement of the actuating rod, the piston 82 remains positionally fixed on and relative to the actuating rod and thus correspondingly moves forward (i.e. to the left in FIG. 1) relative to the barrel 14.

As earlier pointed out, the dispenser 10 is depicted in FIG. 1 in the condition of having an associated closure cap 23 removably mounted about its forward or discharge end. Although the cap may take on any suitable form including, in the most simple or basic construction, a single-element cup-like member, the cap 23 illustrated in the drawing comprises a multiplicity of relatively movable and cooperating parts. Thus, the cap 23 includes a cup-shaped head section 88, an outer extension sleeve 90, a relatively movable interior shuttle member 92, and a compression spring 94 extending between the head 88 and shuttle 92. The particular form of cap employed is of substantially no importance with respect to the substantive aspects and teachings of the present invention.

Figure 3:
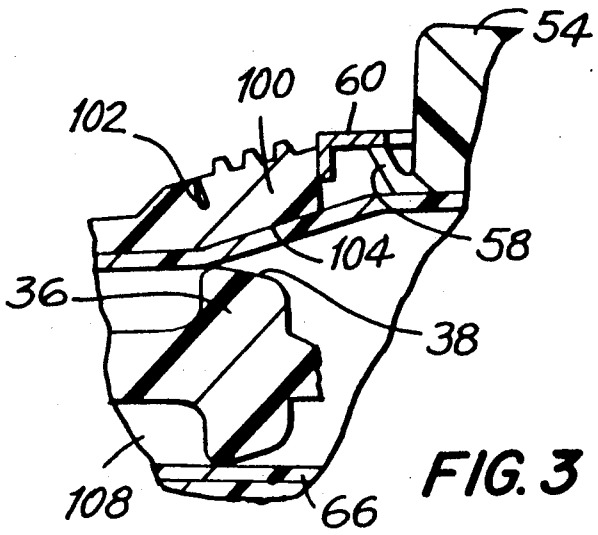
FIG. 3 is a detail of a portion of the FIG. 1 dispenser as that portion appears with the associated closure cap removed from about the discharge end of the dispenser.

In any event, the cap extension sleeve 90 is provided, at its rear or open end, with interior threads 96 for rotative engagement with correspondingly configured outer threads 98 on the dispenser nosetip 18. The threads 98 are located on the nosetip immediately adjacent the forwardmost edge or boundary of the cutout 53 and extend circumferentially about the nosetip. Adjacent the forwardmost edge of cutout 53, the threads 98 are defined in a tab 100 that is flexibly and unitarily connected to the nosetip 18 for radially-inward, limited pivotal displacement, relative to the remainder of the nosetip body, about a reduced thickness connection portion 102. The inwardly displaced position of the tab 100, in which its angled locking surface 104 is disposed in engagement, through the interposed and inwardly flexed containment barrier wall 66, with the ramped engagement surface 38 of the actuating rod-carried locking boss 36, is depicted in FIG. 1. The normal or nondisplaced or radially-outer position in which the tab 100 lies when the cap 23 is unattached to or not disposed about the discharge end of the dispenser, and to which it resiliently or otherwise returns when the initally-seated cap is removed from about the dispenser's discharge end, is illustrated in the detail of FIG. 3. Thus, as the closure cap 23 is rotatably threaded or screwed into fully seated engagement with the discharge end of the dispenser, the tab 100 is gradually inwardly depressed or displaced to its FIG. 1 position. Modified constructions in which additional tabs or housing portions are defined on or circumferentially about the nosetip body for resilient inward displacement into engagement with additional surface portions of the boss 36 are also contemplated.

As should be apparent, the tab surface 104 and boss surface 38 are correspondingly ramped or angled or oriented so that, when the closure cap 23 is fully seated or disposed on the discharge end of the dispenser 10, the automatically-effected inward displacement of the tab 100 places its locking surface 104 in substantial surface-to-surface engagement, through the interposed barrier wall 66, with the ramped surface 38 on the boss 36. This substantial engagement of the surfaces 104, 38 is effective to prevent rearward longitudinal movement of the actuating rod 28 from its FIG. 1 position and, thereby, to prevent unseating of the stopper 30 with the brush head passageway periphery 27 and thereby preclude an operative discharge of fluid through the dispenser discharge opening 22. Moreover, since the actuating rod 28 is locked against rearward, longitudinal fluid-discharging movement, the actuating button 54 is correspondingly locked against and prevented from radially-inward displacement through the engagement of the curved camming surfaces 74, 78.

The manner in which the dispenser 10 operates, in response to a manually or otherwise-effected, operator-controlled inward displacement of the actuating button 54, should now be evident. It is of course assumed for purposes of the following description that the closure cap 23 has been removed from and is not, accordingly, disposed over the discharge end of the dispenser. Inward displacement of the button 54, pivotally about its extension 56, inwardly flexibly deforms the containment barrier wall or membrane 66 adjacent the button and, through the interposed membrane 66, correspondingly inwardly drives and resiliently displaces the forward end of the lever arm 72 of lever guide 70. The complementary engagement of the curved camming surfaces 74 (on the lever arm 72) and 78 (on the actuating rod boss 74) drives the actuating rod 28 rearward, against the urgency of the spring 80, whereby the stopper 30 is carried out of its fluid discharge outlet closing engagement with the brush head wall. At the same time, the rearward movement of the actuating rod 28 forces the valve disk 48 into engagement with the ledge 50, thereby closing the passage 52 which connects the barrel-defining fluid storage reservoir 106 and the relatively forward discharge chamber 108 bounded by the nosetip 18. In addition, as the rod 28 is rearwardly displaced it slides relatively through the piston 82 which remains positionally fixed with respect to the peripheral wall of the barrel 14. With the fluid discharge opening 22 thereby opened, and the valve disk 48 sealing the discharge chamber 108 at its rearward end, the inwardly flexed deformation of the barrier wall 66 results in a volumetric decrease in the discharge chamber. That volumetric decrease effects a corresponding pressure increase and stored fluid contained in the discharge chamber 108 is forcibly (i.e. hydraulically) dispensed or discharged or ejected onto the applicator brush 20 through the discharge opening 22 of the dispenser. Thus, the barrier wall 66, in addition to its fluid tight and corrosion resistant fluid containment functions, acts as a mechanically-driven hydraulic actuator pump for operatively driving a discharge of fluid contained within the interior of the dispenser 10. It should also be pointed out that the optional inclusion of one or more windows 62 in the nosetip 18 provides area(s) within which the PTFE barrier wall 66 may outwardly partially flex as the actuating button 54 is depressed, thereby reducing the resistance to and, correspondingly, the force required to inwardly displace the button 54.

When the actuating button is released, when, that is, the application of inwardly-directed force or pressure to the top of button 54 is discontinued, the button is automatically returned to its relatively outward, FIG. 1 position. More particularly, the restorative or expansion-driven urgency of compression spring 80 effects a forward or leftward displacement of the actuating rod 28 to return the rod-carried stopper 30 into sealing engagement with the periphery of the brush head passageway 27. This closes the fluid discharge opening 22 of the dispenser and prevents the further discharge of fluid therefrom. As the rod 28 is so returned to its first or normal or outlet closing position, the engagement of the complementary curved surfaces 74, 78 effects a return movement, assisted by the restorative forces inherent in the resilient lever arm 72, of the arm 72. This radially-outward return displacement of the arm 72 correspondingly carries the actuating button 54 to or toward its initial, outward, nondisplaced position (FIG. 1). The return of the button 54 to this initial position may also be assisted by resilient return forces in the flexibly deformed containment barrier wall 66.

As the actuating rod 28 is returned from its rearward (fluid discharge outlet open) to its forward (discharge outlet closed) position, the piston 84 remains positionally fixed on the actuating rod and therefore moves correspondingly forwardly, with respect to the barrel sidewall, toward the fluid discharge chamber 108. This results in a volumetric reduction in the fluid storage reservoir 106 and a corresponding pressure increase therein. Since the forward movement of the rod 28 also forwardly displaces the diametrically reduced portion 44 on which the valve member 42 is carried, the increased pressure in the reservoir forces the valve disk 48 out of sealing abutment with the ledge 50 and drives stored fluid contained in the reservoir 106 into the discharge chamber 108, thereby replenishing the fluid dispensed from the discharge chamber during the preceding inward displacement of the actuating button 54 and preparing the dispenser for the next operator-driven fluid discharging operation.

Thus, the provision of a PTFE containment barrier fabricated in accordance with the present invention provides a variety of advantages and enhanced functionality not heretofore realized or achievable in the dispensing of volatile fluids. First, the use of PTFE as the material of construction of the barrier provides a highly reliable and maintainable fluid tight and corrosion and deterioration resistant lining effective for containing an unusually wide variety and range of relatively volatile fluids including, by way of example and not limitation, ethylacetate, butylacetate, isoparafin and tolulene such as is commonly found in nail polish. In addition, because the PTFE barrier is so fabricated as to present a flexibly deformable wall or membrane, it is particularly useful in dispensers for such volatile fluids wherein contained fluid is discharged through an operation in which a member or wall portion or the like is inwardly depressible or displaceable, the barrier thereby performing a mechanical actuation function. Furthermore, by operating in the nature of a bladder for driving a discharge of stored fluid from the dispenser interior, the PTFE barrier performs a hydraulic actuation or pumping function. Thus, the PTFE barrier provides a highly effective volatile fluid containment barrier in a mechanically-operable hydraulic fluid pumping device based on the flexible deformability of the predetermined wall thickness of the PTFE material web. This unusually advantageous result and combination of operating features and attributes has not heretofore been achievable in prior art devices for controlled hydraulic dispensing of volatile fluids.

Those skilled in the art will recognize that numerous modifications to the structural and functional details of the invention, as thus far and hereinafter expressly described in this specification, may be made without departing from its full scope and teachings. With respect to the actuating rod locking arrangement, whereby fluid-discharging movement of the rod, out of its normal position closing or sealing the fluid discharge opening, for example, it is contemplated and intended that the constructural details of the FIG. 1 dispenser embodiment may be significantly varied from that shown in the drawing. Larger or additional portions of the nosetip, or of other housing portion(s) which the closure cap engages when seated about the dispenser discharge end, may inwardly move or flex or be otherwise displaced into locking engagement with a suitably configured lock part, such as the boss 36, that are located on or attached to the actuating rod for precluding movement of the rod. Indeed, that lock part may take on a wide range of forms and configurations, as well as a variety of interaction mechanisms for cooperative engagement with the cap-driven inwardly-movable portion of the housing, substantially as a matter of design choice. An example of an alternate form of the actuator rod-carried lock part is illustrated in FIG. 4.

The modified actuator rod 120, while structurally different from the FIG. 1 rod 28 in various respects, generally operates in a corresponding or, at least, closely analogous manner to the rod 28 to achieve the same or equivalent results. Its forward end carries a tapered valve stopper 122 for closing or sealing engagement with the fluid discharge opening of the dispenser housing. The rod also includes a convexly-curved camming surface 124 cooperatively engageable with a complementary curved engagement surface (such as the surface 74 in FIG. 1) for converting the radially-inward motion of an actuating member or housing portion to an axially-oriented displacement of the rod 120 and enabling a discharge of fluid contained in the dispenser. A flapper or disk-like valve member (not shown), such as the member 42 in FIG. 1, is carried on the rod at a diametrically-reduced portion 126. And, intermediate the valve stopper 122 and the curved camming surface 124, the actuating rod is provided with a lock member, designated in FIG. 4 by the general reference numeral 128, for engagement with a cap-driven, inwardly-displaceable portion of the dispenser housing.

In this alternate embodiment of the actuating rod, the lock member 128 is constructed as a plurality, three are shown in FIG. 4, of legs 130, each of which extends generally radially outwardly from the central shaft 132 of the actuating rod 120 and defines in association with the shaft a substantially U-shaped structure. An engagement surface 134 is provided on the radially-outermost end or head 136 of each leg 130. By fabricating the actuating rod !20, or at least the legs 130 if not unitarily formed on the rod, of an appropriate material such, for example, as nylon or other plastic, and suitably sizing and shaping the legs, they may be rendered resiliently flexible so that, as one or more portions of the housing are inwardly displaced by the seated cap into engagement with at least one of the surfaces 134, the corresponding leg 130 deforms and its head 136 is inwardly displaced by a predetermined amount. This resilient deformation or displacement of one or more legs 130 will effect a frictional or pressure-induced engagement between the surface 134 and the inwardly-displaced housing portion and thereby enhance the intended locking of the actuating rod 120 against movement out of its discharge outlet sealing position. Of course, the engagement surfaces 134 may in addition, or as an alternative to fabricating the legs 130 for resilient flexibility, be sloped or ramped or angled in the manner of the lock member engagement surface 38 in the FIG. 1 embodiment. And as previously noted with respect to the FIG. 1 actuating rod 28, the rod 120, and, more particularly, the inadvertent actuation locking arrangement or feature, may be provided in a dispenser incorporating or, alternatively, omitting a fluid containment barrier constructed in accordance with that aspect of the present invention.

As should also be apparent, although the FIG. 1 embodiment of the invention shows only a single, inwardly-displaceable tab carried on or forming a part of the housing nosetip 18, the housing may instead incorporate or carry multiple such tabs or otherwise displaceable parts. The appropriate portion(s) of the housing with which the closure cap is engageable may alternatively be configured so as provide sufficient flexibility and resilience of the housing material in those portion(s) for general inward flexure or deformation when the cap is seated on the dispenser discharge end. These and other modifications too numerous to expressly mention are within the intended scope and contemplation of the invention.

It should be further recognized that numerous modifications may also be made, with respect to the illustrated FIG. 1 embodiment and in accordance with the invention, to the manner in which the flexible containment barrier is implemented for enabling hydraulically-pumped discharge of a contained fluid. To mention but one example, the fluid storage reservoir may be implemented as a housing part constructed in its entirety of PTFE material configured, for example, as an elongated barrel-like tube of material. In such a dispenser, at least a portion of the PTFE tube has a predetermined thickness selected so as to render that portion, which might constitute an entire 360° circumferential part of the tube, resiliently flexible whereby, to effect an operator-controlled fluid discharge, the user simply squeezes or otherwise forcibly inwardly depresses the flexible portion for hydraulically driving fluid outwardly through a discharge opening suitably defined in the dispenser. A particularly advantageous feature in this regard is that, through the diameter-reducing heating step of the barrier fabrication method of the invention, the initially opaque or cloudy PTFE material is rendered relatively transparent; thus, a fluid storage reservoir formed substantially entirely of the inventive fluid containment barrier will permit a user to readily view its contents and thereby identify, for example, the color and other visible characteristics of the stored fluid. This and many other modified implementations of a flexible PTFE containment barrier should be understood as being within the scope and contemplation of the invention.

The structural and functional operating details of a fluid dispenser incorporating a flexible PTFE containment barrier and/or an inadvertent actuation-preventing locking member or arrangement, in accordance with the invention, can also be considerably modified or different from that depicted and described, by way of illustration, herein. The unidirectionally-movable piston may, for example, be omitted in some dispenser forms, as may the inwardly-depressible actuating button through which a discharge of stored or contained fluid is initiated in the herein disclosed dispenser. Thus, the dispenser 10 of FIG. 1 is intended to constitute merely one currently preferred embodiment of a construction suitable for the intended purpose and in association with which the PTFE containment barrier and inadvertent actuation features of the invention may be employed.

Accordingly, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. It is the intention, therefore, to be limited only as indicated by the scope of the claims appended hereto.

What is claimed is:

1. In a fluid dispenser for operator-controlled discharge of a contained fluid:

an elongated dispenser housing for containing a fluid and including a discharge opening proximate a discharge part of said housing and through which discharge opening contained fluid is operatively releasable;

reciprocatable means normally maintained in a first position closing said discharge opening for preventing a release of contained fluid and movable between said first and a second position in which said discharge opening is opened for enabling a release of contained fluid;

a closure cap removably disposable over said discharge part of the housing during periods of non-use of said fluid dispenser;

said housing having an inwardly displaceable portion located so that, when said closure cap is disposed over said discharge part of the housing, said cap cooperatively engages and inwardly displaces said displaceable portion;

said reciprocatable means including locking means for selectively preventing movement of said reciprocatable means and located on said reciprocatable means so that, when said closure cap is disposed over the discharge part of the housing with said reciprocatable means in said first position thereof, said inwardly displaceable portion is displaced and moved into cooperative engagement with said locking means for thereby preventing movement of said reciprocatable means from said first to said second position so that said discharge opening remains closed and no contained fluid can be released through said discharge opening so long as said cap remains disposed over the housing discharge part.

2. In a fluid dispenser in accordance with claim 1, said reciprocatable means comprising an elongated member longitudinally movable along said housing elongation between said first and second positions.

3. In a fluid dispenser in accordance with claim 2, said displaceable portion of said housing being radially-inwardly displaceable by said cooperative engagement with said cap.

4. In a fluid dispenser in accordance with claim 2, said locking means comprising a radially-outwardly extending member depending from said elongated member.

5. In a fluid dispenser in accordance with claim 3, said locking means comprising a radially-outwardly extending member depending from said elongated member and having a surface for cooperative engagement with said radially-inwardly displaceable portion of said housing.

6. In a fluid dispenser in accordance with claim 2, said discharge part comprising an end of said elongated housing.

7. In a fluid dispenser in accordance with claim 1, said housing comprising an outer peripheral wall of said dispenser and said inwardly displaceable portion of said housing comprising a tab connected to said peripheral wall for pivotal inward displacement into cooperative engagement with said locking means.

8. In a fluid dispenser in accordance with claim 3, said housing comprising an outer peripheral wall of said dispenser and said inwardly displaceable portion of said housing comprising a tab connected to said peripheral wall for pivotal inward displacement into cooperative engagement with said locking means extension.

9. In a fluid dispenser in accordance with claim 1, said housing comprising an outer peripheral wall of said dispenser and said inwardly displaceable portion of said housing comprising a portion of said peripheral wall configured for inward displacement into cooperative engagement with said locking means.

10. In a fluid dispenser in accordance with claim 3, said housing comprising an outer peripheral wall of said dispenser and said inwardly displaceable portion of said housing comprising a portion of said peripheral wall configured for inward displacement into cooperative engagement with said locking means extension.

11. In a fluid dispenser in accordance with claim 4, said radially-outwardly extending member being resiliently flexible for radially-inward deformation by said inwardly displaceable housing portion when said housing portion is inwardly displaced by cooperative engagement with said closure cap.

12. In a fluid dispenser in accordance with claim 2, said locking means comprising a boss extending radially outwardly from said elongated member for cooperative engagement with said inwardly-displaceable housing portion.

13. In a fluid dispenser in accordance with claim 12, said locking means boss having a ramped surface for cooperative engagement with said inwardly-displaceable housing portion.

14. In a fluid dispenser in accordance with claim 13, said inwardly-displaceable housing portion having a surface angled for cooperative engagement with said locking means boss ramped surface.

15. In a fluid dispenser in accordance with claim 12, said locking means boss having a ramped surface and said inwardly-displaceable housing portion having a surface disposed for substantial surface-to-surface engagement with said locking means boss surface.

16. In a fluid dispenser in accordance with claim 12, said locking means boss having a portion configured for resiliently deformable engagement with said inwardly-displaceable housing portion.

* * * * *